US005664520A

United States Patent [19]

Latimer, III

[11] Patent Number: 5,664,520

[45] Date of Patent: Sep. 9, 1997

[54] HOOD PROP ROD GRIPPING DEVICE

[75] Inventor: John S. Latimer, III, Bloomfield Hills, Mich.

[73] Assignee: Chrysler Corporation, Highland Park, Mich.

[21] Appl. No.: 368,266

[22] Filed: Dec. 29, 1994

[51] Int. Cl.[6] ..... A47B 95/02

[52] U.S. Cl. ..... 16/114 R; 16/116 R; 16/DIG. 12; 74/558.5

[58] Field of Search ..... 16/114 R, 116 R, 16/111 R, 119, 110 A, DIG. 12; 248/351, 345.1; 74/558.5, 551.8, 551.9; 180/69.2, 69.21; 292/DIG. 14

[56] References Cited

U.S. PATENT DOCUMENTS

| | | | |
|---|---|---|---|
| 293,752 | 2/1884 | Krahenbeihl | 16/DIG. 12 |
| 397,719 | 2/1889 | Heikes | 16/DIG. 12 |
| 1,554,635 | 9/1925 | Klann . | |
| 1,830,383 | 11/1931 | Bos . | |
| 1,976,411 | 10/1934 | Olson | 16/DIG. 12 |
| 2,049,144 | 7/1936 | Wahlberg . | |
| 2,140,157 | 12/1938 | Huffman . | |
| 2,173,451 | 9/1939 | Lorber . | |
| 2,239,180 | 4/1941 | Kupfer . | |
| 2,434,598 | 1/1948 | Stegall . | |
| 3,072,955 | 1/1963 | Mitchell . | |
| 3,075,069 | 1/1963 | Spadaro . | |
| 3,141,088 | 7/1964 | Johnson . | |
| 3,216,052 | 11/1965 | Hill | 16/116 R |
| 3,563,592 | 2/1971 | Preston . | |
| 4,197,611 | 4/1980 | Bell et al. | 74/558.5 |
| 4,586,579 | 5/1986 | Matsui et al. . | |
| 4,607,870 | 8/1986 | Crisp, Jr. et al. . | |
| 4,858,972 | 8/1989 | Salyer . | |
| 4,890,355 | 1/1990 | Schulten | 74/551.9 |
| 4,941,232 | 7/1990 | Decker et al. . | |
| 5,160,105 | 11/1992 | Miller | 248/345.1 |

FOREIGN PATENT DOCUMENTS

| | | |
|---|---|---|
| 1430882 | 12/1968 | Germany . |
| 2903310 | 8/1979 | Germany . |
| 3007126 | 9/1980 | Germany . |

*Primary Examiner*—Chuck Y. Mah
*Attorney, Agent, or Firm*—Margaret A. Dobrowitsky

[57] ABSTRACT

A gripping device which is attachable to a hood prop rod of an automobile for isolating a user's hand from the heat of a hot prop rod. The gripping device includes a heat-insulating body adapted to be snapped on the hood prop rod. The heat-insulating body may have a longitudinal bore therethrough and a longitudinal slit extending the length of the body and extending into the body to join the longitudinal bore, the longitudinal bore being present for insertion of the prop rod and being sized for interference fit with the prop rod. The longitudinal slit may be defined by two longitudinal tapered leading edges.

8 Claims, 2 Drawing Sheets

HOOD PROP ROD GRIPPING DEVICE

BACKGROUND OF THE INVENTION

1. Field of the Invention

The present invention relates generally to gripping devices for hood prop rods and, more particularly, to heat-isolating gripping devices which snap on to hood prop rods.

2. Description of the Related Art

As is well known in the art, automobiles are equipped with hoods which cover the engine compartment of the automobile. The hoods are designed to be opened for inspection, maintenance, or repair of various parts in the engine compartment and are typically secured open with support or prop rods.

Commonly, a prop rod is an elongated metal structure which is pivotally mounted at one end to a portion of the automobile inside the engine compartment and detachably secured at the other end to another portion of the automobile. When the hood is to be propped open, a person grips the prop rod near the detachable end and detaches the end of the prop rod from the automobile and hooks it to the opened hood in a manner to support the hood in the open position.

In certain engine compartment lay-outs, especially in the newer automobile models which have smaller engine compartments than previous models, the hood prop rods are heated significantly by the engine during operation. For example, prop rods have been known to reach temperatures of up to about 185° F. after operating the automobile.

Needless to say, a person gripping such a hot prop rod would experience burns to the hands or fingers. Therefore, it is highly desirable to provide a device which isolates the heat of a hot prop rod from a user's hand.

It is, therefore, one object of the present invention to provide a hood prop rod gripping device which isolates a user's hand from the heat of a hot prop rod.

It is another object of the present invention to provide a hood prop rod gripping device which is easily and securably attachable to a hood prop rod.

It is yet another object of the present invention to provide a hood prop rod gripping device which is easy and economical to manufacture and is formed of high-temperature-resistant material.

SUMMARY OF THE INVENTION

To achieve the foregoing objects, the present invention is a hood prop rod gripping device which is attachable to a hood prop rod of an automobile for isolating a user's hand from the heat of a hot prop rod. The gripping device includes a heat-insulating body adapted to be snapped on the hood prop rod.

The heat-insulating body may have a longitudinal bore therethrough and a longitudinal slit extending the length of the body and extending into the body to join the longitudinal bore along the entire length of the longitudinal bore. The longitudinal bore is present for insertion of the prop rod and is preferably sized for interference fit with the prop rod. The longitudinal slit may be defined by two longitudinal tapered leading edges.

In a more specific embodiment, the heat-insulating body has a cylindrically-shaped member having an outer diameter and the cylindrically-shaped member has a cylindrically-shaped longitudinal bore therethrough defining an inner diameter. The inner diameter defined by the longitudinal bore is preferably from about 2 to about 20 percent smaller than the diameter of the prop rod, and the outer diameter of the cylindrically-shaped member is from about 2 to about 2.5 times larger than the inner diameter defined by the longitudinal bore. The body is preferably formed of a rubber material which, after being subjected to 100° C. of dry heat for 70 hours, has a maximum Shore A durometer of about 95, a minimum tensile strength of about 9 MPa, and a minimum elongation of about 112 percent. Additionally, it is desirable that the material, at a temperature of −40° C., may be caused to bend 180° onto itself without breaking.

Other objects, features, and advantages of the present invention will be readily appreciated as the same becomes better understood after reading the subsequent description taken in conjunction with the appendant drawings.

DETAILED DESCRIPTION OF THE PREFERRED EMBODIMENT(S)

Figure 3:
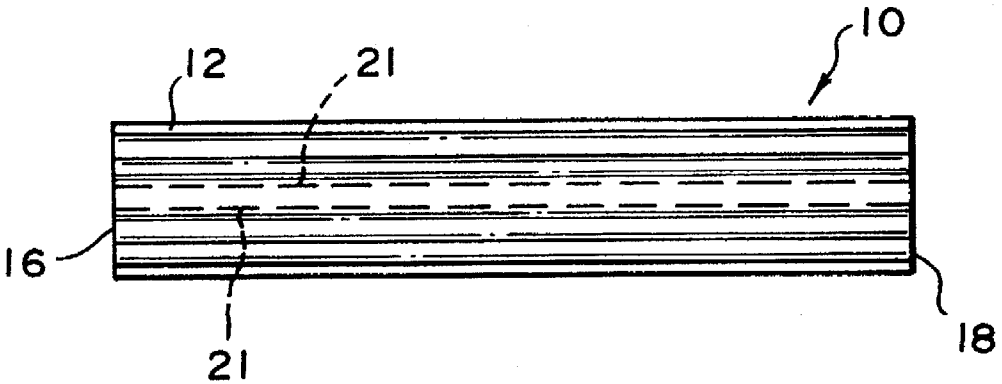
FIG. 3 is a side view of the gripping device of FIG. 1.
Figure 2:
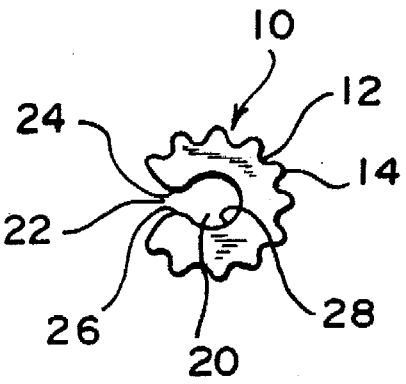
FIG. 2 is a cross-sectional view of the gripping device of FIG. 1, the cross section taken along line 2—2 of FIG. 1.
Figure 1:
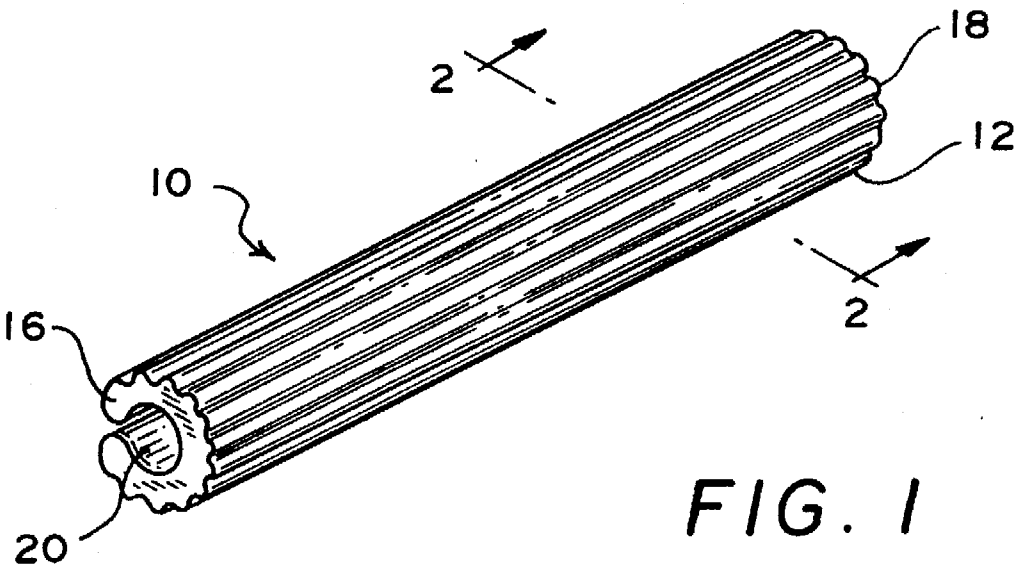
FIG. 1 is a perspective view of a hood prop rod gripping device according to the present invention.

Referring to FIGS. 1 through 3, a hood prop rod gripping device is generally indicated by reference numeral 10. FIG. 2 is a cross sectional view of gripping device 10, the cross section taken along line 2—2 of FIG. 1. Gripping device 10 is a heat-insulating body having flexible member 12. Member 12 is shown to be cylindrically-shaped having circular outer surface 14 defined by a transverse cross section of the member. However, the outer surface of member 12 could have a shape other than circular, e.g., square, hexagonal, etc., without deviating from the purpose of the present invention.

Gripping device 10 has ends 16 and 18 and longitudinal bore 20 therethrough extending from end 16 to end 18 thereby creating an opening in each end 16 and 18. Longitudinal bore 20 is shown by dotted lines 21 in FIG. 3.

Gripping device 10 also has longitudinal slit 22 in the side of and extending the length of member 12. Longitudinal slit 22 is preferably straight and leads to and joins longitudinal bore 20 along the entire length of longitudinal bore 20. Gripping device 10 is attachable to a hood prop rod by inserting the hood prop rod through longitudinal slit 22 and into longitudinal bore 20.

Longitudinal slit 22 is defined by leading edges 24 and 26 which are tapered for easier attaching of device 10 on a hood prop rod. Leading edges 24 and 26 are preferably tapered on the outside of member 12 and, more preferably, they are also tapered on the inside facing longitudinal bore 20. The tapering of leading edges 24 and 26 could be, for example, in the form of a bevel, i.e., angular, or rounded, as shown.

Preferably, the width of longitudinal slit 22 is from about 25 to about 50 percent, more preferably, from about 30 to about 45 percent, of the diameter of the hood prop rod for which it is designed.

Inner surface 28 defined by longitudinal bore 20 is preferably smooth, as shown, to allow maximum frictional fit on the prop rod. However, inner surface 28 could have other textures or protrusions extending therefrom. Inner surface 28 is shown being cylindrically-shaped having a circular transverse cross section; however, other shapes may suffice. The cross sectional shape of inner surface 28 is preferably the same shape as the outer surface of the hood prop rod for which the gripping device is designed.

Outer surface 14 has equidistant longitudinal ribs extending outwardly therefrom for an easier grip by the user and for some reinforcement of member 12. The number and size of the ribs are dictated in part by the efficacy and the method of manufacture of the device. The distance between the longitudinal ribs should be great enough to allow the desired flexibility in member 12 for easy attachment onto the hood prop rod.

Alternative to having longitudinal ribs, but not preferred, outer surface 14 may be smooth, have a different texture thereon, e.g., a knurled surface or annular grooves, or have appendages other than ribs extending therefrom.

Longitudinal bore 20 defines the inner diameter of member 12. Preferably, the inner diameter of member 12 is smaller than the diameter of the hood prop rod on which the gripping device is to be attached, thereby resulting in an interference fit between the gripping device and the hood prop rod to keep the gripping device from sliding on the prop rod. Desirably, the inner diameter of member 12 is from about 2 to about 20 percent smaller, more desirably from about 5 to about 16 percent smaller, than the diameter of the hood prop rod for which the gripping device is designed. Typical hood prop rods may be from about 8 millimeters to about 10 millimeters in diameter. Assuming the hood prop rods have diameters from about 8 millimeters to about 10 millimeters, suitable inner diameters of members 12 are from about 0.2 to about 1.6 millimeters smaller, more preferably, from about 0.5 to about 1.3 millimeters smaller, than the diameter of the hood prop rod.

Desirably, the outer diameter of member 12 (excluding the ribs) is from about 2 to about 2.5 times larger than the inner diameter of member 12. As shown and preferred, the thickness of the wall defined between the outer and inner diameters of member 12 is constant along the length of member 12. The dimension of the outer diameter is, in part, dictated by the method of making the device. The dimension of the outer diameter is also dictated by the efficacy of the device in that it has to be large enough to insulate heat from a user's hand. The dimension of the outer diameter is also preferably minimized resulting in a more flexible member, therefore, a more easily attached member. Further, the outer diameter of the member is preferably minimized to achieve the lowest cost of materials needed to form the member.

The length of the gripping device may vary. However, a suitable length is from about 60 to about 130 millimeters which provides enough length for grasping and for the friction needed to keep the gripping device from slipping along the hood prop rod.

Gripping device 10 is preferably made from a flexible material, such as a non-foam rubber, e.g., a rubber compound containing at least 50 weight percent, more desirably, 100 weight percent, peroxide-cured ethylene propylene diene monomer rubber. Gripping device 10 may be formed by extrusion. Conveniently, gripping device 10 is formed of a single material and is a one-piece construction. Preferably, the material of construction has a Shore A durometer of from about 75 to about 85, a tensile strength of at least about 12 MPa, and an elongation of at least 150%, more preferably, at least 200%, is high-temperature and ozone resistant, remains flexible at temperatures below freezing, is non-staining in that, if it gets wet, no color bleeds onto the automobile, and is resistant to change due to contact with water, soap, and car wax.

To determine if a material is suitable for the invention with respect to its resistance to high temperatures, the material is subjected to 100° C. of dry heat for 70 hours according to ASTM D573. After the exposure to the dry heat, a suitable material has a maximum Shore A durometer of about 95, a minimum tensile strength of about 9 MPa, and a minimum elongation of about 112 percent.

To determine if a material is suitable for the invention with respect to its ozone resistance, a test specimen of the material is subjected to ozone in an ozone chamber in accordance with ASTM D1149. The test specimen is prepared in accordance with ASTM D518. According to the test, the specimen is mounted and permitted to relax in an ozone-free atmosphere for 24 hours, then exposed for 70 hours to a concentration of 50 parts by volume ozone per $10^8$ parts of air at 40° C. After the exposure, the specimen preferably maintains its original properties, i.e., a Shore A durometer of from about 75 to about 85, a tensile strength of at least about 12 MPa, and an elongation of at least 150%. The test specimen is also rated in accordance with the procedures outlined in ASTM D1171 which relates to surface cracking of the material. Preferably, the material shows no evidence of surface cracking.

To determine if a material is suitable for the invention with respect to low-temperature flexibility, the material is tested according to ASTM D746 by exposing a specimen to −40° C. and causing the specimen to bend 180° onto itself while it is at −40° C. A preferred material for the invention does not break upon the bending.

To determine if a material is suitable for the invention with respect to non-staining properties, the material is tested according to ASTM D925, Method "B". It is desirable that there be no migration staining or contact staining as determined by this test.

The above-mentioned ASTM methods, that is, ASTM D573, D1149, D518, D1171, D746, and D925, are incorporated herein by reference.

Figure 4:
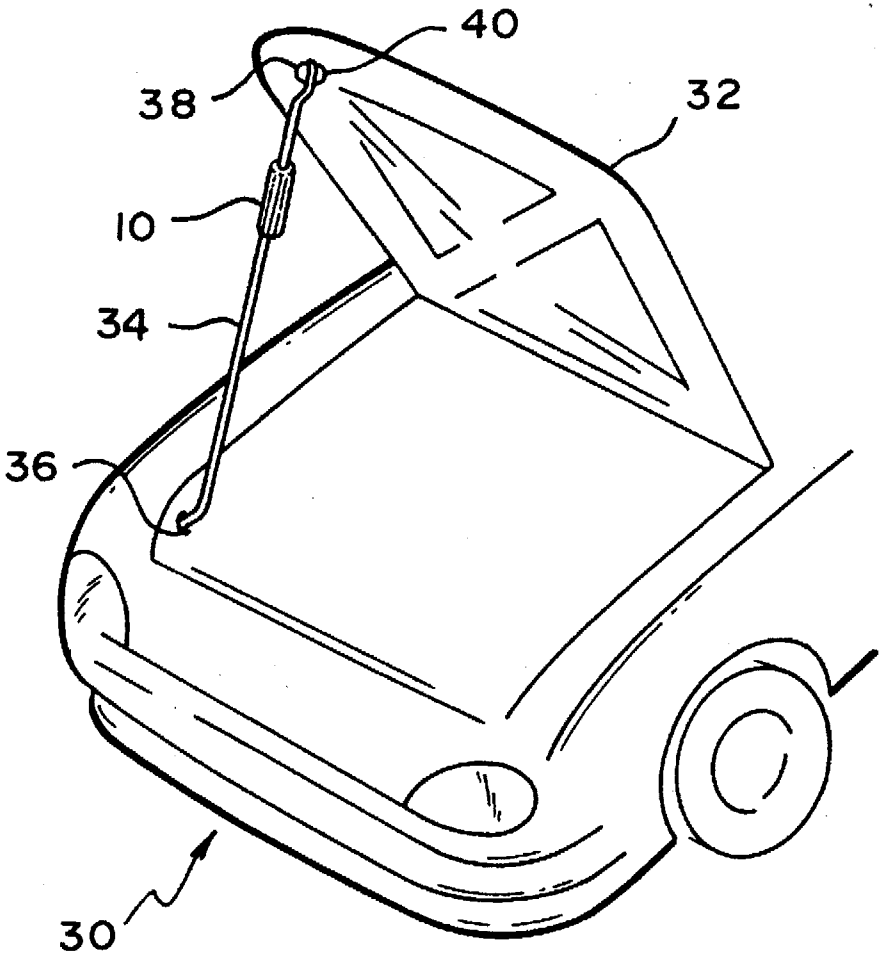
FIG. 4 is a perspective view of an automobile, in part, showing a gripping device according to the present invention attached to a hood prop rod.

FIG. 4 illustrates automobile 30 having hood 32 propped open with hood prop rod 34. Gripping device 10 is shown attached to hood prop rod 34. Hood prop rod 34 has ends 36 and 38. End 36 is pivotally mounted inside the engine compartment of automobile 30. When hood 32 is closed, end 38 is typically detachably attached inside the engine compartment (attachment not shown). End 38 is designed to insert into hole 40 in hood 32 to prop hood 32 open.

As described above, gripping device 10 is snapped onto hood prop rod 34 by inserting hood prop rod 34 through longitudinal slit 22 and into longitudinal bore 20. Gripping device 10 is attached onto hood prop rod 34 near end 38.

To use gripping device 10 and to prop hood 32 open, a person opens the hood, and, by grasping gripping device 10, the person detaches end 38 of hood prop rod 34 from automobile 30, pivots hood prop rod 34 to a position in which end 38 may be inserted into hole 40 in hood 32, and inserts end 38 into hole 40 in hood 32, thereby propping hood 32 open.

Accordingly, the hood prop rod gripping device of the present invention isolates a user's hand from the heat of a hot prop rod, is easily and securably attachable to a hood prop rod, is easy and economical to manufacture, and is formed of high-temperature-resistant material.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A hood prop rod gripping device attachable to a hood prop rod of an automobile for isolating a user's hand from the heat of a hot prop rod, comprising:

a heat-insulating body adapted to be snapped on the hood prop rod, wherein the body is formed of a material which, after being subjected to 100° C. of dry heat for 70 hours, has a maximum Shore A durometer of about 95, a minimum tensile strength of about 9 MPa, and a minimum elongation of about 112 percent.

2. The gripping device of claim 1, wherein the body has a cylindrically-shaped member having an outer diameter, the cylindrically-shaped member having a cylindrically-shaped longitudinal bore therethrough defining an inner diameter, the inner diameter being from about 2 to about 20 percent smaller than the diameter of the prop rod for interference fit of the gripping device on the prop rod, the outer diameter of the cylindrically-shaped member being from about 2 to about 2.5 times larger than the inner diameter defined by the longitudinal bore.

3. The gripping device of claim 1, wherein the body is formed of peroxide-cured ethylene propylene diene monomer rubber.

4. The gripping device of claim 1, wherein the body is formed of a material which, at a temperature of −40° C., can be caused to bend 180° onto itself without breaking.

5. A hood prop rod gripping device attachable to a hood prop rod of an automobile for isolating a user's hand from the heat of a hot prop rod, comprising:

a heat-insulating body adapted to be snapped on the hood prop rod, the body having a cylindrically-shaped member having a longitudinal bore therethrough and a longitudinal slit extending the length of the body and extending into the body to join the longitudinal bore along the entire length of the longitudinal bore, the longitudinal bore present for insertion of the prop rod and being sized for interference fit with the prop rod, the longitudinal slit being defined by two longitudinal leading edges, the leading edges being rounded for easier attachment to the prop rod, the cylindrically-shaped member having an outer diameter, the longitudinal bore being cylindrically-shaped defining an inner diameter, the inner diameter being from about 2 to about 20 percent smaller than the diameter of the prop rod, the outer diameter of the cylindrically-shaped member being from about 2 to about 2.5 times larger than the inner diameter defined by the longitudinal bore, the body being formed of a material which, after being subjected to 100° C. of dry heat for 70 hours, has a maximum Shore A durometer of about 95, a minimum tensile strength of about 9 MPa, and a minimum elongation of about 112 percent.

6. The gripping device of claim 5, wherein the body is formed of peroxide-cured ethylene propylene diene monomer rubber.

7. The gripping device of claim 5, wherein the body is formed of a material which, at a temperature of −40° C., can be caused to bend 180° onto itself without breaking.

8. A hood prop rod gripping device attachable to a hood prop rod of an automobile for isolating a user's hand from the heat of a hot prop rod, comprising:

a heat-insulating body adapted to be snapped on the hood prop rod, the body having a cylindrically-shaped member having an outer diameter, the cylindrically-shaped member having a cylindrically-shaped longitudinal bore therethrough defining an inner diameter, the longitudinal bore defining a smooth inner surface, the inner diameter defined by the longitudinal bore being from about 2 to about 20 percent smaller than the diameter of the prop rod, the outer diameter of the cylindrically-shaped member being from about 2 to about 2.5 times larger than the inner diameter defined by the longitudinal bore, the cylindrically-shaped member further having a longitudinal slit extending the length of the member and extending into the member to join the longitudinal bore along the entire length of the longitudinal bore, the longitudinal slit being defined by two longitudinal leading edges, the leading edges being rounded for easier attachment to the prop rod, the body being formed of a rubber material which, after being subjected to 100° C. of dry heat for 70 hours, has a maximum Shore A durometer of about 95, a minimum tensile strength of about 9 MPa, and a minimum elongation of about 112 percent, and, at a temperature of −40° C. can be caused to bend 180° onto itself without breaking.

* * * * *